US005613535A

United States Patent [19]

Loen

[11] Patent Number: 5,613,535

[45] Date of Patent: Mar. 25, 1997

[54] FUEL DISPENSER SHUTOFF SWITCH

[75] Inventor: Andrew E. Loen, Port Alberni, Canada

[73] Assignee: Shell Oil Company, Houston, Tex.

[21] Appl. No.: 461,487

[22] Filed: Jun. 5, 1995

[51] Int. Cl.[6] ..... B67D 5/00

[52] U.S. Cl. ..... 141/226; 141/5; 141/209; 141/215

[58] Field of Search ..... 141/94–96, 198, 141/206–211, 214, 215, 217, 218, 5, 225, 226

[56] References Cited

U.S. PATENT DOCUMENTS

| | | | |
|---|---|---|---|
| 2,529,936 | 11/1950 | Grise | 141/214 |
| 2,547,690 | 4/1951 | Chadil et al. | 141/209 X |
| 2,675,952 | 4/1954 | Shaffer et al. | 141/209 |
| 2,813,554 | 11/1957 | Flinchbaugh | 141/215 |
| 2,870,799 | 1/1959 | Kinnison | 141/209 |
| 3,100,007 | 8/1963 | Reasby | 141/209 |
| 3,580,414 | 5/1971 | Ginsburgh et al. | 220/86 |
| 3,603,359 | 9/1971 | Belue | 141/208 |
| 3,771,575 | 11/1973 | Mayer | 141/226 X |
| 4,130,148 | 12/1978 | Keller | 141/218 |
| 5,131,441 | 7/1992 | Simpson et al. | 141/209 |
| 5,435,356 | 7/1995 | Rabinovich | 141/226 X |

OTHER PUBLICATIONS

*Technology*, "Pumping Gas in the Year 2000," by Klaus–Ulrich Blumenstock and Konstantin Tschovikov, 3 pp.

*Primary Examiner*—J. Casimer Jacyna
*Attorney, Agent, or Firm*—Del S. Christensen

[57] ABSTRACT

A fuel dispensing unit shutoff switch is provided, the switch comprising: a fuel supply nozzle, having a fuel supply outlet, capable of being inserted into a fuel tank inlet conduit of a vehicle; a plurality of vacuum conduits, each vacuum conduit providing communication between a volume in the vicinity of the fuel supply nozzle outlet, and sources of essentially equal negative pressures; a differential pressure sensor having a plurality of inputs with each input being a point along a different vacuum conduit, and an output signal that is activated when the pressures of the vacuum conduits at the differential pressure sensor inputs differ by more than a threshold amount of differential pressures; and a means effective to stop fuel flow when the output signal is activated. The sources of equal negative pressures are preferably one or more venturies in the fuel supply nozzle, and the threshold amount of differential pressure is preferably between about 0.1 and about 3 inches water of differential pressure.

8 Claims, 1 Drawing Sheet

FUEL DISPENSER SHUTOFF SWITCH

FIELD OF INVENTION

This invention relates to a method and apparatus for dispensing a fluid such a gasoline, and more particularly, to such an apparatus and method utilizing an improved fuel shutoff switch.

BACKGROUND TO THE INVENTION

Numerous apparatuses have been proposed for preventing overfilling of fuel tanks. The most common used method is an automatic cut-off within a nozzle. Typically this automatic cut-off uses a vapor path from the nozzle outlet back to a venturi around the fuel flow path within the nozzle. A sufficiently high pressure must be maintained at a point within this path to indicate that vapor is being drawn into the vapor path rather than liquids. When liquids enter the vapor path, the pressure drop in the path increases, and the pressure at the sensor point will decrease. When this pressure decreased below a threshold pressure, the fuel flow is cut-off, usually by a mechanical trip. When a vapor recovery system that seals the fuel inlet is incorporated in a fuel dispenser, this automatic fuel cut-off will not function properly because pressure at the pressure sensor is subject to variations due to variations in the vapor recovery system. Such variations result in the shutoff not having sufficient consistency.

An electo-mechanical fuel cut-off switch is disclosed in U.S. Pat. No. 5,131,441. This switch includes an electromagnetic clutch that enables the trigger of a nozzle to close. When fluids are detected by a fluid actuated switch located in the nozzle spout, electrical energy to the electromagnetic clutch is interrupted, and the fuel valve is closed. This mechanism is said to be quick-acting, and therefore minimizes splash-back losses to the environment. An optical liquid sensor is suggested as the fluid actuated switch. The fluid actuated switch is located within the nozzle in the fuel dispenser of '441. The location of the switch within the nozzle relies on the fluid level raising within the nozzle. Because vapor is trapped within the closed volume of the nozzle, liquid will not necessarily back-up in the nozzle, but could raise outside the nozzle and be drawn into the vapor recovery system. Liquids could therefore be exiting the fuel tank into the vapor recovery system before the fuel flow is cut off by the mechanism of patent '441.

It is therefore an object of the present invention to provide a method and apparatus for cutting off fuel flow in a fuel dispensing nozzle wherein a vapor recovery system having a seal around a vehicle's fuel inlet can be utilized without effecting the fuel cut-off.

SUMMARY OF THE INVENTION

These and other objects of the present invention are achieved by a fuel dispensing unit shutoff switch comprising: a fuel supply nozzle, having a fuel supply outlet, capable of being inserted into a fuel tank inlet conduit of a vehicle; a plurality of vacuum conduits, each vacuum conduit providing communication between a volume in the vicinity of the fuel supply nozzle outlet, and sources of essentially equal negative pressures; a differential pressure sensor having a plurality of inputs with each input being a point along a different vacuum conduit, and an output signal that is activated when the pressures of the vacuum conduits at the differential pressure sensor inputs differ by more than a threshold amount of differential pressures; and a means effective to stop fuel flow when the output signal is activated.

The switch of the present invention preferably utilizes taps in a venturi in a fuel flow conduit as the source of equal negative pressures. The differential pressure is preferably between about 0.1 and about 3 inches water differential pressure. The means to discontinue fuel flow can be either a valve in the fuel flow conduit or a means to shutdown a fuel pump.

The shut-off switch of the present invention functions even if the fuel tank in question is separated from surrounding atmosphere, and the pressure within the fuel varies. The fuel tank can in communication with a vapor recovery system and sealed with respect to the atmosphere surrounding the fuel nozzle.

DETAILED DESCRIPTION OF THE INVENTION

Figure 1:
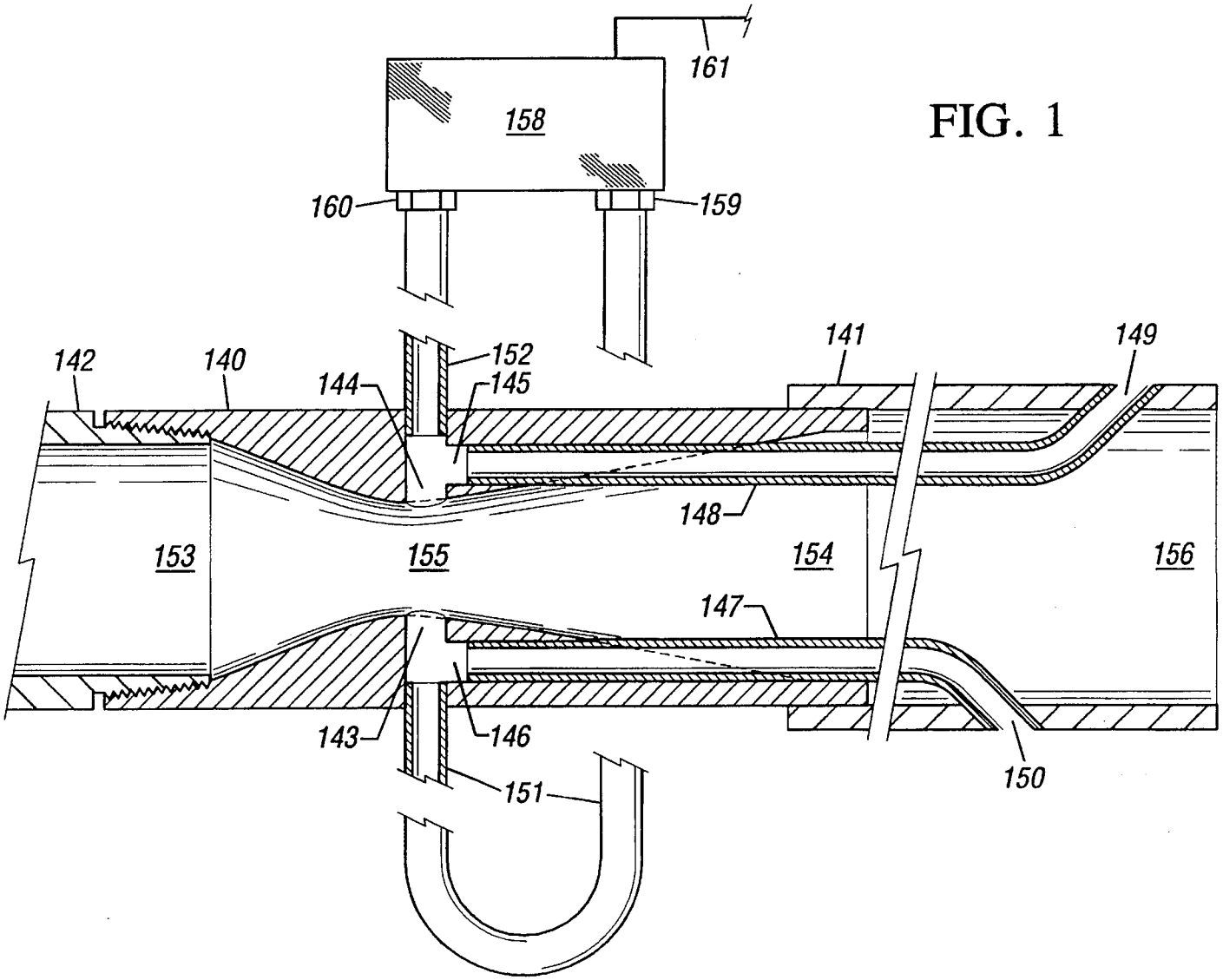
FIG. 1 is a sectional view of a system for the practice of the present invention.

Gasoline refilling stations are typically equipped with vapor recovery systems to reduce emissions of hydrocarbon vapors during refilling of motor vehicles. Such systems vary in their details, but usually comprise a vapor line either concentric around a fuel line, or a second tube extending to near a fuel outlet nozzle. Vapors are drawn through the vapor line at a rate that slightly exceeds the volumetric rate at which gasoline is pumped through the fuel line. A portion of the vapors removed from the vehicle's fuel tank are routed back to the fuel storage tank at the filling station to minimize the amount of vapor eventually vented to the atmosphere, and any vapors vented to the atmosphere are typically passed through an activated carbon filter.

It is also common for a fuel nozzle to be equipped with a seal that mates with a vehicle's fuel inlet to ensure that gasoline vapors do not escape from the fuel tank, and to provide a closer balance between the amount of vapor removed from the vehicle's fuel tank and the amount of vapor needed to maintain pressure in the fuel storage tank at the filling station.

Referring now to FIG. 1, a sketch of a venturi providing two sources of equal negative pressure according to the present invention is shown. A venturi 140 is shown connected by a threaded fitting to a rigid fitting 142 such as, for example, a shutoff valve or a fuel supply pipe at an inlet end of the venturi 153. The venturi has two pressure taps 144 and 143 drilled perpendicular to the axis of the venturi at the throat of the venturi 155. Conduits 151 and 152 lead from the pressure taps to inputs 159 and 160 of a differential pressure switch 158. The pressure taps 143 and 144 also are in communication with channels parallel to the axis of the venturi into which channels tubes 147 and 148 are secured. The taps are preferably in the same horizontal plane to ensure that a bias, or initial differential pressure is not built into the system. It is most preferable that the venturi have a vertical longitudinal axis to provide for a plurality of taps at any convenient angle from each other. If the venturi is positioned at an angle to the horizon that is not 90°, then preferably two taps are provided, one on each side of the venturi through a horizontal line.

The venturi has an outlet end 154 that is connected to a flexible fuel conduit 141. The flexible fuel conduit provides a path for fuel to a fuel outlet 156. The fuel outlet is shown as the end of the flexible conduit, but the fuel outlet could be, alternatively, the end of a typical fuel nozzle. The end of the fuel conduit is preferable suitable for insertion into a fuel tank inlet, and could be a flexible conduit used in an automated refuelling system. The venturi may be machined from a metal, such as stainless steel, or a polymeric material or composit material which is suitable for service with the fluid passing through the venturi.

The tubes 147 and 148 provided communication to the volume surrounding the fuel conduit outlet through passages through the fuel conduit 149 and 150 near the fuel outlet 156. Tubes 147 and 148 are preferably provided within the fuel conduit so that they are not required to contain pressure. They could therfore be made from thin, flexible and inexpensive materials.

The passages 149 and 150 are preferably staged at different distances from the end of the fuel outlet 156. Staging the passages results in the passage nearest the fuel outlet first being contacted with liquid fuel as fuel fills a volume into which the fuel outlet is inserted. The liquid fuel will be drawn through the tube 148, causing a greater pressure drop between the pressure tap 152 and the passage through the fuel conduit 149. This increased pressure drop will cause the pressure at pressure tap 160 to be lower than the pressure at pressure tap 159. This difference in pressure may be, for example, in the range of about 0.1 to about 3 inches of water. This difference is preferably between about 0.1 and one half of an inch of water differential pressure. Differential pressure sensors that are capable of sensing these differences reliably for hydrocarbon liquid service are commercially available and inexpensive.

Although it is preferred that the passages 149 and 150 through the fuel conduit be staged at different distances from the fuel outlet 156, it is not necessary that they are. A fuel level within a fuel tank inlet tube will not rise consistently as fuel is being added at a relatively high rate, but will swirl and splash. Thus, points that are at the same elevation will not come in contact with liquids simitaniously.

The differential pressure sensor 158, when a differential pressure over a preselected minimum is detected, will generate a signal, 161. The signal is preferably used to cause a shut off valve to close, thus discontinuing fuel flow.

A preferred embodiment of the present invention includes two inputs to a differential pressure sensor, but any plurality of inputs couls be provided. Two are preferred because this minimizes the cost of the system.

A venturi is a preferred source of constant negative pressure, but any other common source could be provided. For example, a vacuum system is typically provided for a vapor recovery system, and this vacuum system could provide a source of negative pressure to draw liquids from the vicinity of the fuel supply nozzle outlet. Compressed air could also be used to provide fluid flow through a venturi to create a negative pressure, and either a common supply header or multiple ports to the throat of the venturi could be used to provide sources of equal negative pressure. The venturi in the flow line as described above is preferred because it is inexpensive, simple and reliable.

The method to determine the empty volume of a fuel tank according to the present invention is preferably used with a system to automatically refuel vehicles. In automated refuelling systems, redundant methods to prevent over filling of fuel tanks are desirable, and the method of the present invention can provide one of a plurality of methods to prevent over filling of fuel tanks.

The method of the present invention has been described in connection with a vehicle refuelling system, but the method is broadly applicable to may other systems as can be seen by a person of skill in the art.

A preferred automated refuelling system and method for use with the method of the present invention is disclosed in U.S. patent application Ser. Nos. 08/461,276, 08/461,280, and 08/461,281, incorporated herein by reference.

The foregoing descriptions of preferred embodiments are exemplary, and reference is made to the following claims to determine the full scope of the present invention.

I claim:

1. A fuel dispensing unit shutoff switch comprising:

a fuel supply nozzle, having a fuel supply outlet, capable of being inserted into a fuel tank inlet conduit of a vehicle;

a plurality of vacuum conduits, each vacuum conduit providing communication between a volume in the vicinity of the fuel supply nozzle outlet, and sources of essentially equal negative pressures;

a differential pressure sensor having a plurality of inputs with each input being a point along a different vacuum conduit, and an output signal that is activated when the pressures of the vacuum conduits at the differential pressure sensor inputs differ by more than a threshold amount of differential pressures; and a means effective to stop fuel flow when the output signal is activated.

2. The switch of claim 1 wherein the equal negative pressures are taps in a venturi in a fuel flow conduit.

3. The switch of claim 1 wherein the differential pressure is between about 0.1 and about 3 inches water differential pressure.

4. The switch of claim 1 wherein the means to discontinue fuel flow is a valve in the fuel flow conduit.

5. The switch of claim 1 wherein the means to discontinue fuel flow is a means to shutdown a fuel pump.

6. The switch of claim 1 wherein the plurality of conduits each terminate at different distances from the fuel supply nozzle outlet.

7. A method to prevent overfilling a fuel tank during filling of the fuel tank while filling the tank with fuel, the method comprising the steps of:

providing a fuel dispensing nozzle having a plurality of vacuum inlet points in the vicinity of an outlet of the fuel dispensing nozzle, conduits extending from each of the vacuum inlet points to a source of essentially equal negative pressure, and a means to determine if a threshold amount of difference in pressure exists between points in the conduits;

placing the outlet of the fuel dispensing nozzle into a volume defined by a fuel tank;

flowing fuel through the fuel dispensing nozzle until the threshold amount of difference in pressure exists between the conduits; and discontinuing fuel flow through the fuel dispensing nozzle when the threshold amount of difference in pressure exists between the conduits.

8. The method of claim 7 wherein the common source of essentially equal negative pressure is a venturi through which fuel flow passes.

* * * * *